United States Patent [19]

Sahar

[11] 4,202,133

[45] May 13, 1980

[54] SPINNING TOP

[76] Inventor: Raphael Sahar, 2 King David St., Tiberias, Israel

[21] Appl. No.: 911,177

[22] Filed: May 31, 1978

[51] Int. Cl.[2] ..... A63H 1/06

[52] U.S. Cl. ..... 46/67

[58] Field of Search ..... 46/64, 67, 65, 66

[56] References Cited

U.S. PATENT DOCUMENTS

| | | | |
|---|---|---|---|
| 3,229,413 | 1/1966 | Bross | 46/67 |
| 3,802,117 | 4/1974 | Engelhardt | 46/64 |

*Primary Examiner*—Houston S. Bell

*Attorney, Agent, or Firm*—Browdy and Neimark

[57] ABSTRACT

A spinning top comprises a casing in which is located a gear including a vertical shaft extending downwardly from the casing, the uppermost portion of the said shaft being a Z-profiled bar, the sidewardly extending arms of which are in frictional contact with the ends of oppositely disposed horizontal axles turning in seats provided in the inner wall of the casing. On each of the said horizontal axles a crown wheel is keyed, both crown wheels being in mesh with a pinion, the central axle of which is fixedly connected with the uppermost part of the spinning top casing.

3 Claims, 2 Drawing Figures

SPINNING TOP

BACKGROUND OF THE INVENTION

Spinning tops are well known playthings and are well liked by children (and adults) as devices for outdoor playing. The conventional spinning tops are put into rotation by means of auxiliary devices, such as e.g. a pull-rope which is wound onto part of the top and which—when forcibly pulled imparts rotational movement to the top. In other tops the desired rotation is imparted to the spinning top by means of a spring which is tensioned and which on release sets the top into rotational, spinning movement.

OBJECT OF INVENTION

It is the object of the present invention to provide a spinning top which need not be put into rotation manually by the conventional means referred to above, but which spins automatically on hitting the ground (or any other surface) when dropped from above.

SHORT DESCRIPTION OF DRAWINGS

DETAILED DESCRIPTION OF PREFERRED EMBODIMENT

Figure 2:
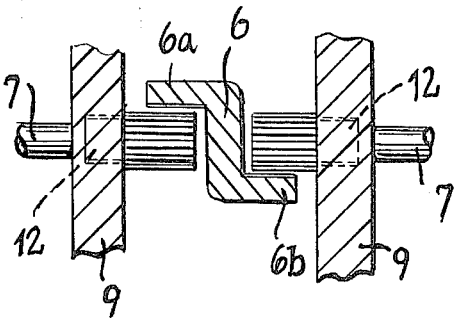
FIG. 2 is a fractional view of line II—II of FIG. 1.
Figure 1:
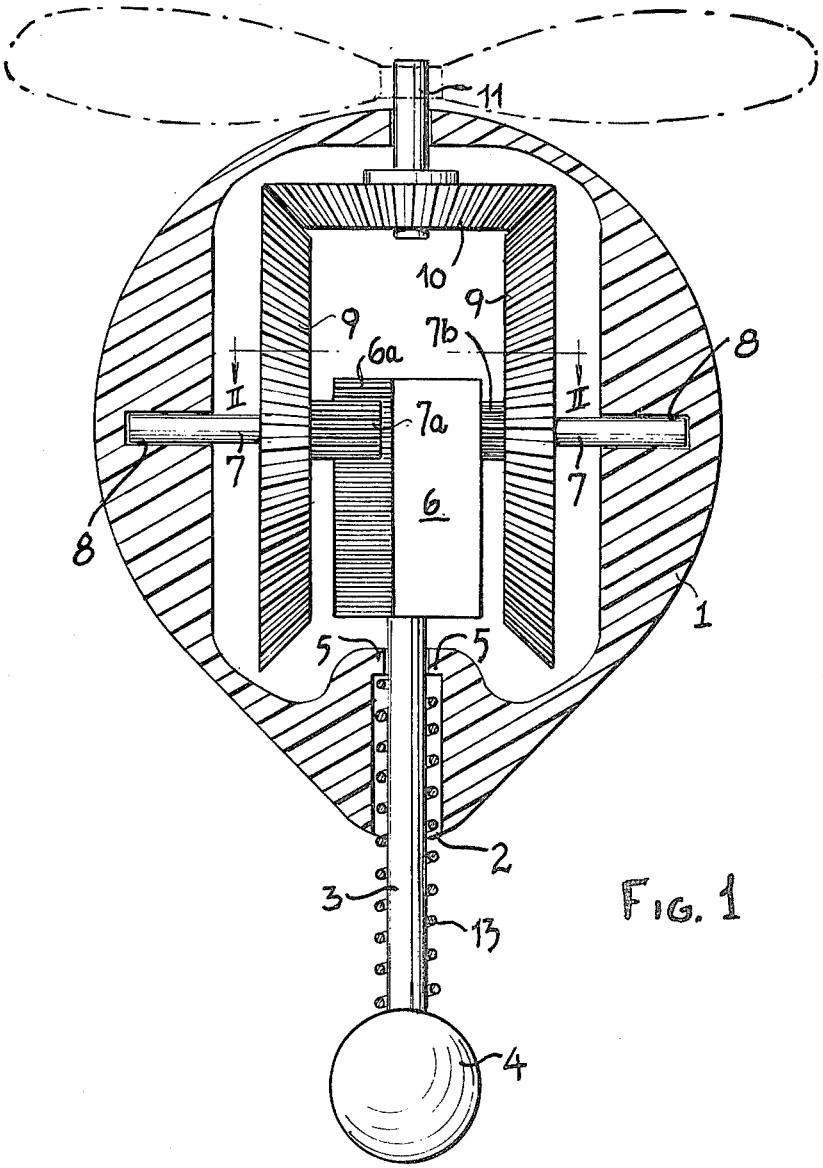
FIG. 1 is an elevational sectional view of the new spinning top.

The new spinning top comprises a pear shaped body or casing indicated by the numeral 1. The downwardly directed point of the pear shaped body has a central bore 2 out of which extends a vertical shaft 3 at the outer end of which is fixed an elastic sphere 4. At the top of bore 2 is formed an annular shoulder 5. A spring 13 extends between shoulder 5 and sphere 4 abutting against both these. To the top (within the body 1) of the shaft 3 is affixed a Z-profiled bar indicated as a whole by the numeral 6. The sidewardly extending portions of the bar 6, indicated by **6*a* and 6*b* are in frictional contact with stubs 7*a* and 7*b* respectively which stubs are extensions of two horizontal axles 7 which are seated in recesses 8 provided in the inner wall of the body 1. The two axles 7 are co-directionally positioned. On each of the axles 7 is keyed a crown wheel 9, both meshing with a pinion 10. From pinion 10 extends a rod 11 which passes through the uppermost wall of the body 1** and is fixedly connected therewith.

As indicated in both figures of the drawing, the stubs **7*a* and 7*b* are connected with wheels 9 by ratched mechanisms 12 permitting rotational movement of the two crown wheels in one direction only, i.e. to be imparted movement by shaft 3 moving inwardly, while the outward movement of the shaft 3, under urge of spring 13 does not affect the two crown wheels 9**.

DESCRIPTION OF OPERATION

The new top is used in the following way:

It is thrown up in the air and is permitted to drop to the ground. It will drop with the sphere 4 first hitting the ground, this being due to the fact that this part (i.e. the "point" of the pear shaped body 1) being made heavier than the rest of contrivance. Due to forcibly hitting the ground, the shaft 3 is pushed inwardly the body 1 with the arm **6*a* and 6*b*—in frictional contact with stubs 7*a* and 7*b* respectively, rotating the latter. As a consequence both wheels 8 are rotated, which in turn rotate the pinion 9. This latter being fixedly connected with body 1** causes the latter to spin.

After hitting the ground and having moved inwardly of body 1, the shaft 3 is again caused to move outwardly by the spring 11.

It would be within the scope of the invention to provide horizontal wings to the outer end of rod 11. This would cause the top to hover in the air once it has bounced after hitting the ground.

I claim:

1. A spinning top comprising a hollow body having an inwardly extending bore in which slides a shaft the innermost end of which carries a Z-profiled member, the sidewardly extending portions of the said Z-profiled member being in frictional contact with oppositely disposed, co-directional axles seated rotationally in the wall of the said hollow body, a crown wheel being fixedly keyed on each of the said axles, both said crown wheels meshing with a pinion which is fixedly connected to the said hollow body.

2. The spinning top claimed in claim 1 characterised thereby that the outer end of the said shaft carries an elastic sphere.

3. The spinning top claimed in claim 1 characterised thereby that the said shaft is surrounded by a spring urging the shaft outwardly of the hollow body.

* * * * *